US011391146B2

(12) United States Patent
Al Daif et al.

(10) Patent No.: US 11,391,146 B2
(45) Date of Patent: Jul. 19, 2022

(54) CORING WHILE DRILLING

(71) Applicant: Saudi Arabian Oil Company, Dhahran (SA)

(72) Inventors: Mohammed Y. Al Daif, Qatif (SA); Ahmed Jaafari, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/074,099

(22) Filed: Oct. 19, 2020

(65) Prior Publication Data

US 2022/0120177 A1 Apr. 21, 2022

(51) Int. Cl.

| | |
|---|---|
| ***E21B 49/06*** | (2006.01) |
| ***E21B 10/02*** | (2006.01) |
| ***E21B 25/16*** | (2006.01) |
| ***E21B 25/10*** | (2006.01) |
| ***E21B 25/00*** | (2006.01) |

(52) U.S. Cl.

CPC ..... *E21B 49/06* (2013.01); *E21B 10/02* (2013.01); *E21B 25/00* (2013.01); *E21B 25/10* (2013.01); *E21B 25/16* (2013.01)

(58) Field of Classification Search

CPC . E21B 4/02; E21B 10/02; E21B 25/00; E21B 25/10; E21B 25/16; E21B 49/06

See application file for complete search history.

(56) References Cited

U.S. PATENT DOCUMENTS

| | | | |
|---|---|---|---|
| 2,043,225 | A | 6/1936 | Armentrout et al. |
| 2,227,729 | A | 1/1941 | Lynes |
| RE32,345 | E | 3/1987 | Wood |
| 5,163,522 | A | 11/1992 | Eaton et al. |
| 5,803,186 | A | 9/1998 | Berger et al. |
| 6,047,239 | A | 4/2000 | Berger et al. |
| 6,330,913 | B1 | 12/2001 | Langseth et al. |
| 6,622,554 | B2 | 9/2003 | Manke et al. |
| 7,086,463 | B2 | 8/2006 | Ringgenberg et al. |
| 7,124,819 | B2 | 10/2006 | Ciglenec et al. |
| 7,647,980 | B2 | 1/2010 | Corre et al. |

(Continued)

FOREIGN PATENT DOCUMENTS

| | | |
|---|---|---|
| CA | 2158903 | 3/1996 |
| CA | 2249432 | 9/2005 |

(Continued)

OTHER PUBLICATIONS

Schlumberger, "CERTIS: Retrievable, single-trip, production-level isolation system," www.slb.com/CERTIS, 2017, 2 pages.

(Continued)

*Primary Examiner* — Tara Schimpf

(74) *Attorney, Agent, or Firm* — Fish & Richardson P.C.

(57) ABSTRACT

A subterranean formation is drilled using a drill bit of a bottomhole assembly to form a wellbore in the subterranean formation. The bottomhole assembly includes a storage chamber and sidewall coring bits. While the bottomhole assembly is disposed within the wellbore, a sidewall of the wellbore is cut into using the sidewall coring bits to obtain sidewall core samples. While cutting into the sidewall of the wellbore using the sidewall coring bits, fluid is circulated through the wellbore. The sidewall core samples are received within the storage chamber.

14 Claims, 5 Drawing Sheets

(56) References Cited

U.S. PATENT DOCUMENTS

| | | | |
|---|---|---|---|
| 8,162,080 | B2 | 4/2012 | Castillo |
| 9,051,810 | B1 | 6/2015 | Cuffe et al. |
| 9,238,961 | B2 | 1/2016 | Bedouet |
| 9,494,010 | B2 | 11/2016 | Flores |
| 2002/0066563 | A1 | 6/2002 | Langseth et al. |
| 2005/0022987 | A1 | 2/2005 | Green et al. |
| 2005/0133267 | A1 | 6/2005 | Reid et al. |
| 2006/0248949 | A1 | 11/2006 | Gregory et al. |
| 2008/0053652 | A1 | 3/2008 | Corre et al. |
| 2010/0006339 | A1 | 1/2010 | Desai |
| 2011/0094801 | A1 | 4/2011 | Buchanan et al. |
| 2011/0155368 | A1 | 6/2011 | El-Khazindar |
| 2013/0056276 | A1 | 3/2013 | Rousseau et al. |
| 2014/0300895 | A1 | 10/2014 | Pope et al. |
| 2015/0027724 | A1 | 1/2015 | Symms |
| 2018/0148988 | A1* | 5/2018 | Dusterhoft ..... E21B 49/06 |

FOREIGN PATENT DOCUMENTS

| | | |
|---|---|---|
| CA | 2594042 | 8/2012 |
| EP | 2596205 | 5/2019 |
| WO | WO 1997021904 | 6/1997 |
| WO | WO 2002020944 | 3/2002 |
| WO | WO 2017196303 | 11/2017 |

OTHER PUBLICATIONS

Weatherford, "RFID Advanced Reservoir Management System Optimizes Injection Well Design, Improves Reservoir Management," Weatherford.com, 2013, 2 pages.

Wellbore Service Tools: Retrievable tools, "RTTS Packer," Halliburton: Completion Tools, 2017, 4 pages.

PCT International Search Report and Written Opinion in International Appln. No. PCT/US2021/055572, dated Feb. 1, 2022, 13 pages.

* cited by examiner

CORING WHILE DRILLING

TECHNICAL FIELD

This disclosure relates to obtaining core samples from subterranean formations.

BACKGROUND

A core sample is typically a cylindrical section of a naturally-occurring substance. Core samples can be obtained by drilling into a subterranean formation with a coring bit. Core samples can be analyzed to determine properties of the subterranean formation. For example, tests can be run on core samples to determine oil and gas levels within the subterranean formation. In most cases, core samples are tagged with context information (for example, relative location within the subterranean formation from which the core sample was obtained), so that a map of properties of the subterranean formation may be generated.

SUMMARY

This disclosure describes technologies relating to obtaining core samples from subterranean formations, and in particular, obtaining sidewall core samples. Certain aspects of the subject matter described can be implemented as a method. A subterranean formation is drilled using a drill bit of a bottomhole assembly to form a wellbore in the subterranean formation. The bottomhole assembly includes a storage chamber and sidewall coring bits. While the bottomhole assembly is disposed within the wellbore, a sidewall of the wellbore is cut into using the sidewall coring bits to obtain sidewall core samples. While cutting into the sidewall of the wellbore using the sidewall coring bits, fluid is circulated through the wellbore. The sidewall core samples are received within the storage chamber.

This, and other aspects, can include one or more of the following features.

In some implementations, the bottomhole assembly includes a hydraulic motor coupled to each sidewall coring bit. In some implementations, cutting into the sidewall of the wellbore using the sidewall coring bits includes using the hydraulic motor to rotate each sidewall coring bit.

In some implementations, the sidewall coring bits are distributed around a circumference of the bottomhole assembly.

In some implementations, each sidewall coring bit is disposed at the same depth along a longitudinal length of the bottomhole assembly.

In some implementations, the bottomhole assembly is retained in the wellbore between drilling the subterranean formation and cutting into the sidewall of the wellbore.

In some implementations, after storing the sidewall core samples within the storage chamber, the bottomhole assembly is pulled out of the wellbore, the sidewall core samples are retrieved from the storage chamber, and the sidewall core samples are analyzed.

In some implementations, the method includes drilling further into the subterranean formation using the drill bit of the bottomhole assembly after receiving the sidewall core samples within the storage chamber.

In some implementations, the bottomhole assembly is retained in the wellbore between receiving the sidewall core samples and drilling further into the subterranean formation.

In some implementations, cutting into the sidewall of the wellbore proceeds at a first depth within the wellbore. In some implementations, the sidewall core samples is a first group of sidewall core samples. In some implementations, the method includes, after drilling further into the subterranean formation, cutting into the sidewall of the wellbore at a second depth within the wellbore using the sidewall coring bits to obtain a second group of sidewall core samples. In some implementations, the method includes receiving the second group of sidewall core samples within the storage chamber.

In some implementations, the storage chamber includes subsections. In some implementations, receiving the first group of sidewall core samples within the storage chamber includes receiving the first group of sidewall core samples within a first subsection of the storage chamber. In some implementations, receiving the second group of sidewall core samples within the storage chamber includes receiving the second group of sidewall core samples within a second subsection of the storage chamber.

In some implementations, the first subsection of the storage chamber is correlated to the first depth. In some implementations, the second subsection of the storage chamber is correlated to the second depth.

Certain aspects of the subject matter described can be implemented as a bottomhole assembly. The bottomhole assembly includes a drill bit, sidewall coring bits, a hydraulic motor, and a storage chamber. The drill bit is at an end of the bottomhole assembly. The drill bit is configured to rotate to cut into a subterranean formation and form a wellbore in the subterranean formation. The sidewall coring bits are distributed around a circumference of the bottomhole assembly. Each sidewall coring bit is configured to, in response to being rotated, cut into a sidewall of the wellbore formed by the drill bit and obtain a sidewall core sample. The hydraulic motor is coupled to each sidewall coring bit. The hydraulic motor is configured to rotate each sidewall coring bit independent of the rotation of the drill bit. The storage chamber is disposed between the drill bit and the sidewall coring bits. The storage chamber is configured to receive and store the sidewall core sample obtained by any one of the sidewall coring bits.

This, and other aspects, can include the following feature. In some implementations, each sidewall coring bit is disposed at the same depth along a longitudinal length of the bottomhole assembly.

Certain aspects of the subject matter described can be implemented as a computer-implemented method. A bottomhole assembly includes sidewall coring bits. While the bottomhole assembly is disposed at a first depth within a wellbore in a subterranean formation, a first sidewall coring signal is transmitted to cause the sidewall coring bits to obtain a first group of sidewall core samples. In response to obtaining the first group of sidewall core samples, each of the first group of sidewall core samples is tagged with a first identifier and at least one of the first depth or a timestamp at which the first group of sidewall core samples was obtained. While the bottomhole assembly is disposed at a second depth within the wellbore, a second sidewall coring signal is transmitted to cause the sidewall coring bits to obtain a second group of sidewall core samples. In response to obtaining the second group of sidewall core samples, each of the second group of sidewall core samples is tagged with a second identifier and at least one of the second depth or a timestamp at which the second group of sidewall core samples was obtained.

This, and other aspects, can include one or more of the following features.

In some implementations, the bottomhole assembly includes a storage chamber. In some implementations, the method includes determining that the first group of sidewall core samples is stored within a first portion (for example, a first subsection) of the storage chamber. In some implementations, the method includes determining that the second group of sidewall core samples is stored within a second portion (for example, a second subsection) of the storage chamber.

In some implementations, the method includes generating a map of the subterranean formation at least based on the first depth, the second depth, the first group of sidewall core samples, and the second group of sidewall core samples.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

A bottomhole assembly (BHA) is the lower portion of a drill string used to create wellbores in subterranean formations. The bottomhole assembly provides force for a drill bit to break rock to form the wellbore. The bottomhole assembly is configured to operate in hostile mechanical environments encountered during drilling operations and to provide directional control of a well. The bottomhole assembly includes a sidewall coring tool. The sidewall coring tool is configured to obtain a side core sample from the subterranean formation while drilling operations occur. Obtained side core samples can be stored within the bottomhole assembly during drilling and subsequently be retrieved once drilling operations are complete. The sidewall coring tool can include multiple sidewall coring bits, such that side core samples can be obtained from various sides of the wellbore. A hydraulically driven motor can be used to operate the sidewall coring bits. The subject matter described here can be implemented to realize one or more of the following advantages. Because the sidewall coring operation occurs while drilling, fluid can be continuous circulated during the coring operation, thereby improving safety of the coring operation and well control during the coring operation. The bottomhole assembly can obtain side core samples even in cases of losses of circulation during drilling operations. This feature can improve depth and formation control and can mitigate jeopardizing well objectives. Valuable information about the subterranean formation can be obtained from the core samples even in cases of lost circulation.

Figure 1:
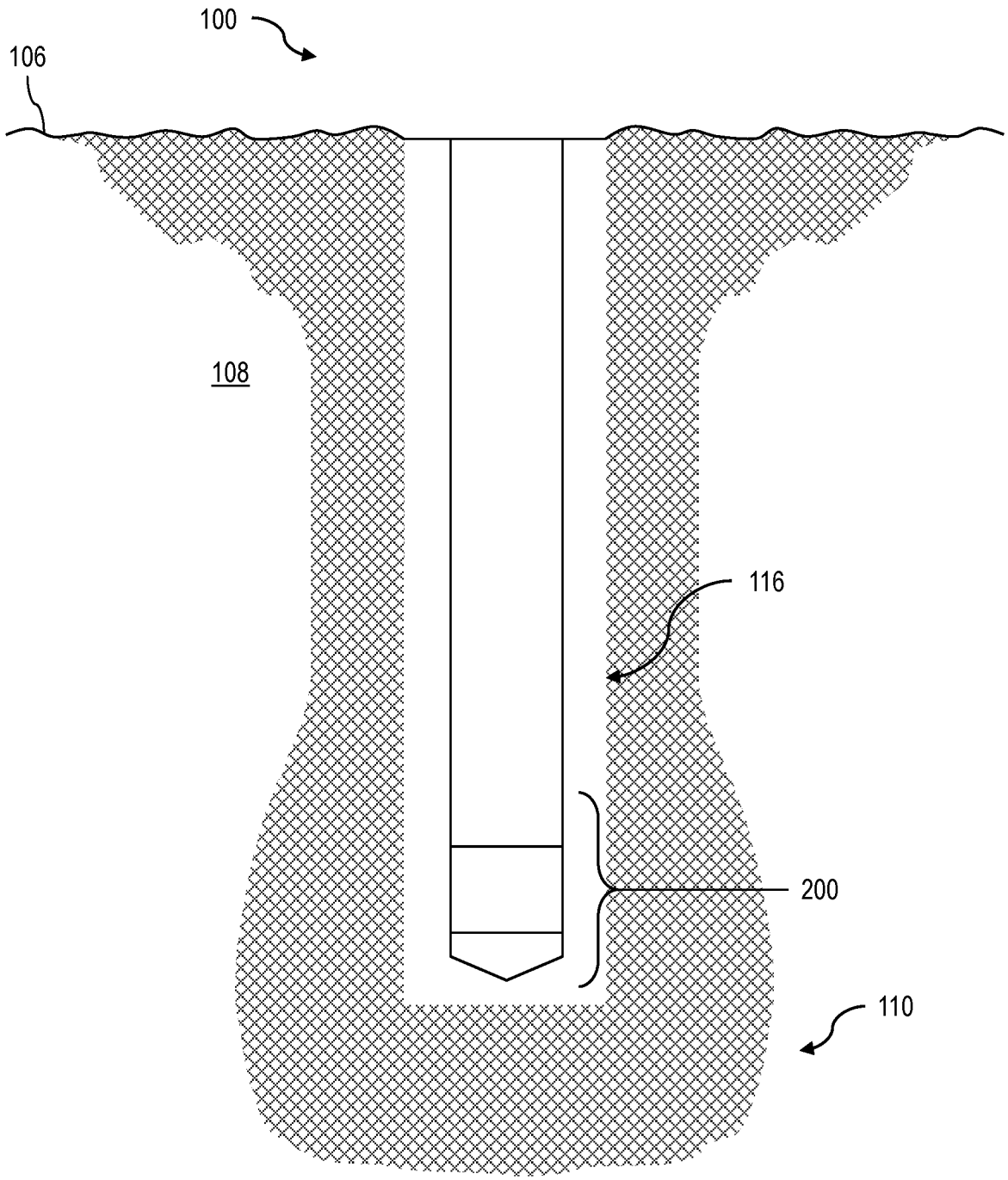
FIG. 1 is a schematic diagram of an example well.

FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth. The wellbore of the well 100 is typically, although not necessarily, cylindrical.

A drillstring can be used to drill the wellbore. The lower portion of the drillstring can include a bottomhole assembly 200. The bottomhole assembly 200 is configured to provide force to break rock, survive a hostile mechanical environment, and provide directional control of the well 100. Additionally, the construction of the components of the bottomhole assembly 200 are configured to withstand the impacts, scraping, and other physical challenges the bottomhole assembly 200 will encounter while being passed hundreds of feet/meters or even multiple miles/kilometers into and out of the well 100. Beyond just a rugged exterior, this encompasses having certain portions of any electronics being ruggedized to be shock resistant and remain fluid tight during such physical challenges and during operation.

Figure 2:
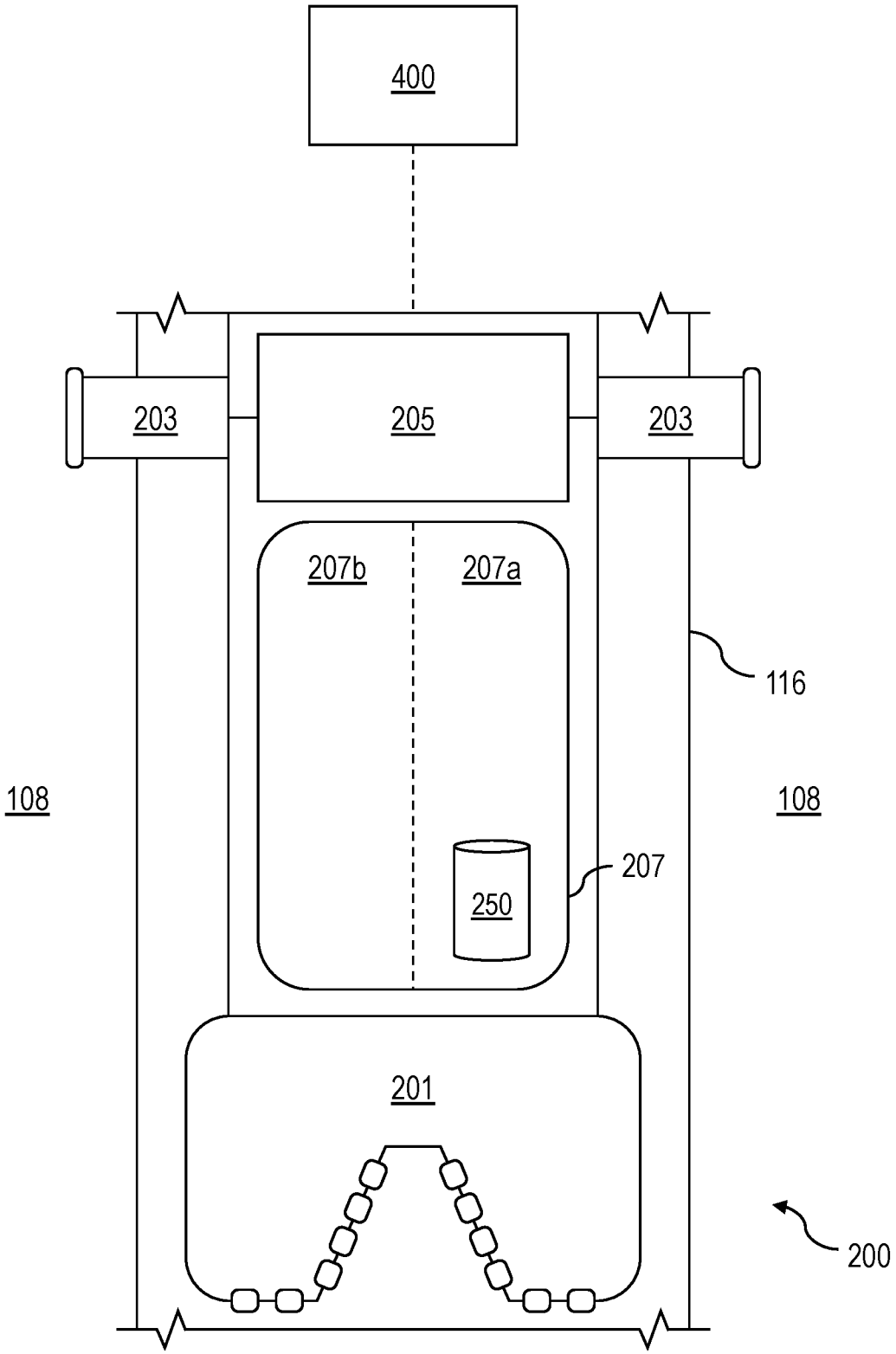
FIG. 2 is a schematic diagram of an example bottomhole assembly that can be used to form the well of FIG. 1.

FIG. 2 is a schematic diagram of an implementation of the bottomhole assembly 200. The bottomhole assembly 200 includes a drill bit 201, sidewall coring bits 203, a hydraulic motor 205, and a storage chamber 207. The drill bit 201 is positioned at an end of the bottomhole assembly 200 and is configured to rotate to cut into the subterranean formation, thereby forming a wellbore in the subterranean formation (for example, to form the well 100 shown in FIG. 1). While rotating, the drill bit 201 scrapes rock, crushes rock, or both to form the wellbore. The rotational axis of the drill bit 201 can coincide with the longitudinal axis of the bottomhole assembly 200. In some implementations, the drill bit 201 includes polycrystalline diamond compact. In some implementations, the size of the drill bit 201 is in a range of from 5% inches to 8½ inches. For example, the size of the drill bit 201 is 5' inches, 6⅛ inches, 8⅜ inches, or 8½ inches. The drill bit 201 can be connected to typical equipment known in the art, for example, a mud motor, a stabilizer, a near bit reamer, a measurement while drilling (MWD) tool, or a logging while drilling (LWD) tool.

The sidewall coring bits 203 are distributed around a circumference of the bottomhole assembly 200. In response to being rotated, each of the sidewall coring bits 203 are configured to cut into a sidewall of the wellbore formed by the drill bit 201 to obtain a sidewall core sample 250. The rotation of the sidewall coring bits 203 are independent of the rotation of the drill bit 201. For example, the sidewall coring bits can be rotated while the drill bit 201 is rotating, and the sidewall coring bits can be rotated while the drill bit 201 is not rotating. In some implementations, the sidewall coring bits 203 are in the form of hollow core drills. The sidewall coring bits 203 can be rotated to obtain cylindrical sidewall core samples. The rotational axes of the sidewall coring bits 203 deviate from the longitudinal axis of the bottomhole assembly 200. In some implementations, the rotational axes of the sidewall coring bits 203 deviate from the longitudinal axis of the bottomhole assembly 200 at an angle in a range of from 45 degrees (°) to 135°. For example, the rotational axes of the sidewall coring bits 203 are perpendicular (angle of) 90° to the longitudinal axis of the bottomhole assembly 200. In some implementations, the sidewall coring bits 203 include polycrystalline diamond compact. For example, the bodies of the sidewall coring bits 203 can be made of a metallic material bonded to a polycrystalline diamond compact cutter on the side of the sidewall coring bits 203 that is put into contact and cuts into the sidewall of the subterranean formation. In some implementations, the sidewall coring bits 203 have cylindrical shapes. In some implementations, the diameter of each of the sidewall coring bits 203 is in a range of from 1 inch to 2 inches. In some implementations, the length of each of the sidewall coring bits 203 is about 2 inches.

In some implementations, the sidewall coring bits 203 are configured to move to retract into and extend from the bottomhole assembly 200. The sidewall coring bits 203 can be retracted within the bottomhole assembly 200 such that the sidewall coring bits 203 do not protrude radially from the bottomhole assembly 200, for example, while the drill bit 201 is rotating to drill into the subterranean formation and form the wellbore. The drilling operation can be paused, and the sidewall coring bits 203 can be extended from the bottomhole assembly 200 to obtain a sidewall core sample 250. Once the sidewall core sample 250 has been obtained, the sidewall coring bits 203 can be retracted back within the bottomhole assembly 200 to resume drilling operations. This procedure can be repeated at various depths within the wellbore without pulling the bottomhole assembly 200 out of the wellbore.

While shown in FIG. 2 as obtaining a single sidewall core sample 250, more than one of the sidewall coring bits 203 can be used to obtain multiple sidewall core samples 250. Further, any of the sidewall coring bits 203 can be used multiple times within the same wellbore to obtain multiple sidewall core samples 250, for example, at different depths within the wellbore. In some implementations, the sidewall core samples 250 have diameters less than 1 inch. In some implementations, the sidewall core samples 250 have lengths in a range of from 0.75 inches to 4 inches.

The hydraulic motor 205 is coupled to each sidewall coring bit 203 and configured to rotate each sidewall coring bit 203. The hydraulic motor 205 is a mechanical actuator that converts hydraulic pressure and/or flow into torque and rotation. In some implementations, the hydraulic motor 205 can be operated by electric power to rotate the sidewall coring bits 203. The hydraulic motor 205 uses hydraulic pressure to rotate the sidewall coring bits 203 independent of the rotation of the drill bit 201. When the bottomhole assembly 200 is disposed within the wellbore, the hydraulic motor 205 is positioned uphole of the drill bit 201.

In some implementations, the hydraulic pressure is provided to the hydraulic motor 205 by drilling mud or any typical drilling fluid. In some implementations, the hydraulic pressure is provided to the hydraulic motor 205 by pumping a fluid from the surface to the hydraulic motor 205.

The storage chamber 207 is positioned between the drill bit 201 and the sidewall coring bits 203. The storage chamber 207 is configured to receive and store the sidewall core sample 250 obtained by any of the sidewall coring bits 203. In some implementations, the storage chamber 207 includes multiple subsections, such as subsections 207*a* and 207*b*. Although shown in FIG. 2 as including two subsections (207*a*, 207*b*), the storage chamber 207 can include additional subsections, such as three or more subsections. In some implementations, the storage chamber 207 is in the form of a tubular disposed within the bottomhole assembly 200. In some implementations, the storage chamber 207 is partitioned into its various subsections (such as subsections 207*a* and 207*b*) by a baffle. In some implementations, each subsection (such as subsections 207*a* and 207*b*) is a tubular disposed within the storage chamber 207. In some implementations, the storage chamber 207 is sized to store up to 60 core samples. In some implementations, the longitudinal length of the storage chamber 207 is up to 10 feet.

In implementations in which the storage chamber 207 includes multiple subsections (such as subsections 207*a* and 207*b*), the storage chamber 207 is equipped with an open/close mechanism that allows control of material entering the subsection, remaining within the subsection, or exiting the subsection. For example, each subsection (207*a*, 207*b*) can be equipped with a solenoid valve. The open/close mechanism can be controlled, for example, by the computer system 400.

In some implementations, the sidewall coring bits 203 are disposed at various longitudinal positions along a longitudinal length of the bottomhole assembly 200. For example, each of the sidewall coring bits 203 can be disposed at different depths along the longitudinal length of the bottomhole assembly 200. In some implementations, some of the sidewall coring bits 203 are disposed at the same longitudinal position along the longitudinal length of the bottomhole assembly 200 while the remaining sidewall coring bits 203 are disposed at different longitudinal positions along the longitudinal length of the bottomhole assembly 200.

In some implementations, the bottomhole assembly 200 is communicatively coupled to a computer system 400. In such implementations, the computer system 400 can control operations of the bottomhole assembly 200. For example, the computer system 400 can be configured to control the sidewall coring bits 203 to obtain the sidewall core samples from the subterranean formation. In some implementations, the computer system 400 is configured to be deployed downhole, for example, with the bottomhole assembly 200. In some implementations, the computer system 400 remains at the surface. The computer system 400 is described in more detail later and is also shown in more detail in FIG. 4.

Figure 3A:
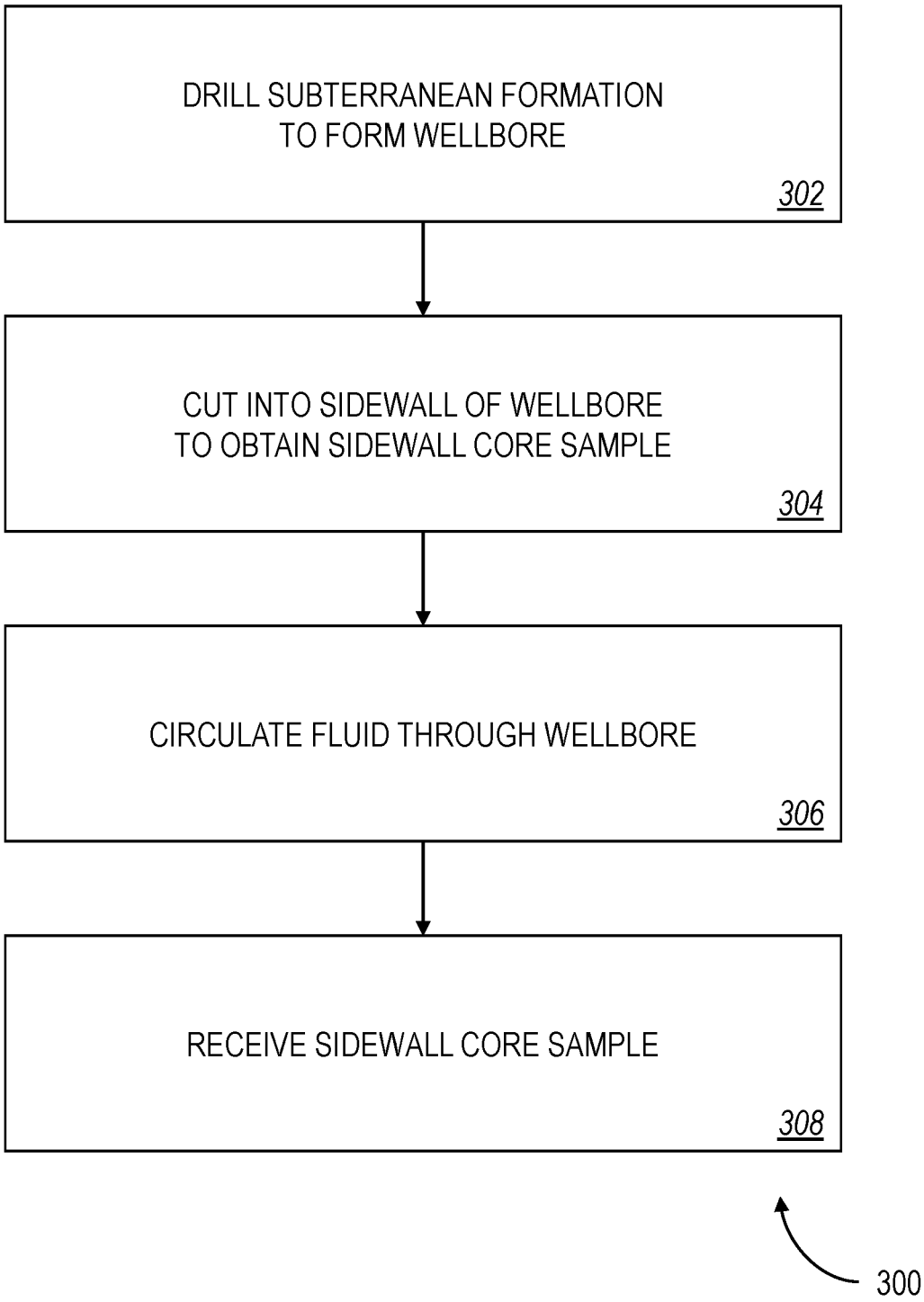
FIG. 3A is a flow chart of an example method for obtaining sidewall core samples.

FIG. 3A is a flow chart of a method 300 for obtaining sidewall core samples (such as the sidewall core samples 250). The bottomhole assembly 200 can be used to implement method 300. At step 302, a subterranean formation is drilled using a drill bit of a bottomhole assembly (such as the drill bit 201 of the bottomhole assembly 200) to form a wellbore in the subterranean formation (such as the well 100). As described previously, the bottomhole assembly 200 includes the storage chamber 207 and sidewall coring bits 203. When the bottomhole assembly 200 is disposed within a wellbore, the storage chamber 207 and sidewall coring bits 203 are positioned uphole of the drill bit 201.

At step 304, a sidewall of the wellbore is cut into using the sidewall coring bits 203 to obtain sidewall core samples 250 while the bottomhole assembly is disposed within the wellbore. As described previously, the bottomhole assembly 200 includes the hydraulic motor 205 that is coupled to the sidewall coring bits 203. Cutting into the sidewall of the wellbore using the sidewall coring bits 203 at step 304 can include using the hydraulic motor 205 to rotate the sidewall coring bits 203 to obtain sidewall core samples 250. Cutting into the sidewall of the wellbore using the sidewall coring bits 203 at step 304 can include extending the sidewall coring bits 203 from the bottomhole assembly 200, rotating the sidewall coring bits 203 to cut into the sidewall of the wellbore, and then retracting the sidewall coring bits 203 back into the bottomhole assembly 200.

In some implementations, the sidewall coring bits 203 are distributed around a circumference of the bottomhole assembly 200, and the sidewall core samples 250 obtained at step 304 are from the same depth within the wellbore. In some implementations, the longitudinal positions of the sidewall coring bits along the longitudinal length of the bottomhole assembly 200 vary. In such implementations, the sidewall core samples 250 obtained at step 304 are from varying depths within the wellbore. In some implementations, each sidewall core sample 250 can be tagged, for example, by the computer system 400, with a depth within the wellbore at which the respective sample 250 was obtained, a timestamp at which the respective sample 250 was obtained, or both. In some implementations, the samples 250 can later be analyzed, for example, by the computer system 400, and a map of the subterranean formation can be generated from the analysis results and identifying tags (depth, timestamp, or both).

At step 306, fluid is circulated through the wellbore while the sidewall coring bits 203 are used to cut into the sidewall of the wellbore at step 304. Circulating fluid at step 306 can improve safety of the coring operation at step 304, improve depth and formation control, and mitigate jeopardizing well objectives. A non-limiting example of an appropriate fluid that can be circulated through the wellbore at step 306 includes drilling mud.

At step 308, the sidewall core samples 250 (obtained at step 306) are received by the storage chamber 207. In some implementations, the sidewall core samples 250 obtained at step 306 are extracted from the sidewall coring bits 203. The sidewall core samples 250 are then stored within the storage chamber 207. In implementations where the storage chamber 207 includes multiple subsections (such as subsections 207*a* and 207*b*), the method 300 can include storing the sidewall core samples 250 within a subsection (207*a* or 207*b*) and also tracking which samples 250 are stored within which subsection 207*a* or 207*b*.

The bottomhole assembly 200 can be retained within the wellbore throughout the duration of method 300. For example, the bottomhole assembly 200 is retained within the wellbore between steps 302 and 304. In some implementations, after step 308, step 302 is repeated to drill further into the subterranean formation and extend the wellbore. In such implementations, the bottomhole assembly 200 is retained within the wellbore between step 308 and the second iteration of step 302. Therefore, the entire method 300 can be implemented by the bottomhole assembly 200 in a single run.

In some implementations, the method 300 proceeds at a first depth within the wellbore, and the method 300 is repeated at a second depth within the wellbore. For example, step 304 proceeds at a first depth within the wellbore. The sidewall core samples 250 stored at step 308 are a first group of sidewall core samples. The first group of sidewall core samples can be stored in the subsection 207*a* of the storage chamber 207. Then, after repeating step 302 to drill further into the subterranean formation, step 304 is repeated at a second depth within the wellbore to obtain a second group of sidewall core samples 250. Step 306 can be repeated throughout the second iteration of step 304. Step 308 can be repeated to store the second group of sidewall core samples within the second subsection 207*b* of the storage chamber 207. In such implementations, the method 300 can include correlating the first group of sidewall core samples stored in the first subsection 207*a* to the first depth. In such implementations, the method 300 can include correlating the second group of sidewall core samples stored in the second subsection 207*b* to the second depth.

Figure 3B:
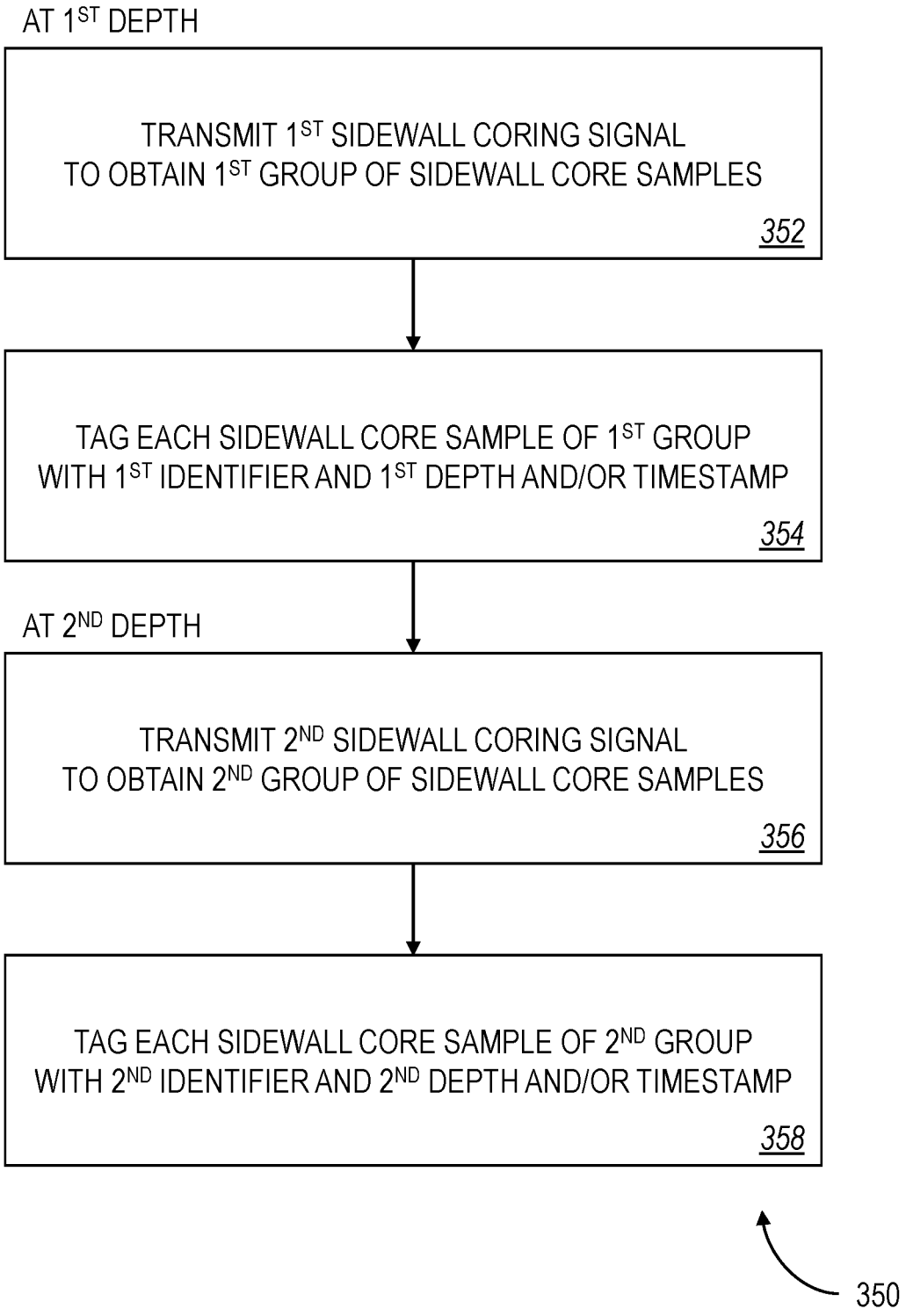
FIG. 3B is a flow chart of an example computer-implemented method for obtaining sidewall core samples.

FIG. 3B is a flow chart of a method 350 for obtaining sidewall core samples (such as the sidewall core samples 250). The method 350 can be a computer-implemented method performed by a computer system, for example, the computer system 400 communicatively coupled to the bottomhole assembly 200. At step 352, a first sidewall coring signal is transmitted to cause sidewall coring bits of a bottomhole assembly (such as the sidewall coring bits 203 of the bottomhole assembly 200) to obtain a first group of sidewall core samples (for example, sidewall core samples 250) while the bottomhole assembly 200 is disposed at a first depth within a wellbore in a subterranean formation. For example, the first sidewall coring signal is transmitted to the hydraulic motor 205 at step 352 to cause the sidewall coring bits 203 to rotate and obtain the first group of sidewall core samples 250.

In some implementations, the first sidewall coring signal causes the sidewall coring bits 203 to extend from the bottomhole assembly 200 and then causes the hydraulic motor 205 to rotate the sidewall coring bits 203 to obtain the first group of sidewall core samples 250. In some implementations, the method 350 includes determining whether the first group of sidewall core samples 250 has been obtained. In some implementations, after determining that the first group of sidewall core samples 250 has been obtained, the method 350 includes transmitting a first retracting signal to retract the sidewall coring bits 203 back into the bottomhole assembly 200. Once obtained, the first group of sidewall core samples 250 is received and stored within the storage chamber 207.

At step 354, each sidewall core sample of the first group is tagged with a first identifier and at least one of the first depth or a timestamp at which the first group of sidewall core samples was obtained. In some implementations, the first group of sidewall core samples 250 is stored within a subsection (207*a* or 207*b*) of the storage chamber. In some implementations, the method 350 includes choosing a subsection (for example, 207*a* or 207*b*) within which the first group of sidewall core samples 250 is to be stored and transmitting a signal that results in allowing the first group of sidewall core samples 250 to enter and be stored in the chosen subsection while preventing the first group of sidewall core samples 250 from entering a non-chosen subsection. For example, once the subsection has been chosen, the method 350 can include transmitting an open signal to the chosen subsection and a close signal to the remaining non-chosen subsections, such that the first group of sidewall core samples 250 enters the chosen subsection. In some implementations, the method 350 includes determining which subsection of the storage chamber that the first group of sidewall core samples 250 is stored in, and associating the determined subsection with the first identifier and at least one of the first depth or the timestamp at which the first group of sidewall core samples 250 was obtained. After step 354 and before step 356, the bottomhole assembly 200 is moved from the first depth to a second depth within the wellbore.

At step 356, a second sidewall coring signal is transmitted to cause the sidewall coring bits 203 to obtain a second group of sidewall core samples while the bottomhole assembly 200 is disposed at the second depth within the wellbore. For example, the second sidewall coring signal is transmitted to the hydraulic motor 205 at step 356 to cause the sidewall coring bits 203 to rotate and obtain the second group of sidewall core samples.

In some implementations, the second sidewall coring signal causes the sidewall coring bits 203 to extend from the bottomhole assembly 200 and then causes the hydraulic motor 205 to rotate the sidewall coring bits 203 to obtain the second group of sidewall core samples. In some implementations, the method 350 includes determining whether the second group of sidewall core samples has been obtained. In some implementations, after determining that the second group of sidewall core samples has been obtained, the method 350 includes transmitting a second retracting signal to retract the sidewall coring bits 203 back into the bottomhole assembly 200. Once obtained, the second group of sidewall core samples is received and stored within the storage chamber 207.

At step 358, each sidewall core sample of the second group is tagged with a second identifier and at least one of the second depth or a timestamp at which the second group of sidewall core samples was obtained. In some implementations, the second group of sidewall core samples is stored within a subsection (207*a* or 207*b*) of the storage chamber. In some implementations, the method 350 includes choosing a subsection (for example, 207*a* or 207*b*) within which the second group of sidewall core samples is to be stored and transmitting a signal that results in allowing the second group of sidewall core samples to enter and be stored in the chosen subsection while preventing the second group of sidewall core samples from entering a non-chosen subsection. For example, once the subsection has been chosen, the method 350 can include transmitting an open signal to the chosen subsection and a close signal to the remaining non-chosen subsections, such that the second group of sidewall core samples enters the chosen subsection. In some implementations, the method 350 includes determining which subsection of the storage chamber that the second group of sidewall core samples is stored in, and associating the determined subsection with the second identifier and at least one of the second depth or the timestamp at which the second group of sidewall core samples was obtained.

In implementations where the storage chamber 207 includes multiple subsections (such as subsections 207*a* and 207*b*), the method 350 can include determining whether the first group of sidewall core samples is stored within the first subsection 207*a* or the second subsection 207*b*. Similarly, the method 350 can include determining whether the second group of sidewall core samples is stored within the first subsection 207*a* or the second subsection 207*b*.

In some implementations, the method 350 includes generating a map of the subterranean formation at least based on the first depth, the second depth, the first group of sidewall core samples, and the second group of sidewall core samples. In some implementations, the method 350 includes analyzing the first group of sidewall core samples. In some implementations, the map includes analysis results of the first group of sidewall core samples. In some implementations, the method 350 includes analyzing the second group of sidewall core samples. In some implementations, the map includes analysis results of the second group of sidewall core samples. In some implementations, the map includes measurements taken during drilling operations (for example, measurement-while-drilling (MWD), logging-while-drilling (LWD), or both). For example, generating the map of the subterranean formation can include matching the analysis results with the depths at which the respective sidewall core samples were obtained.

Figure 4:
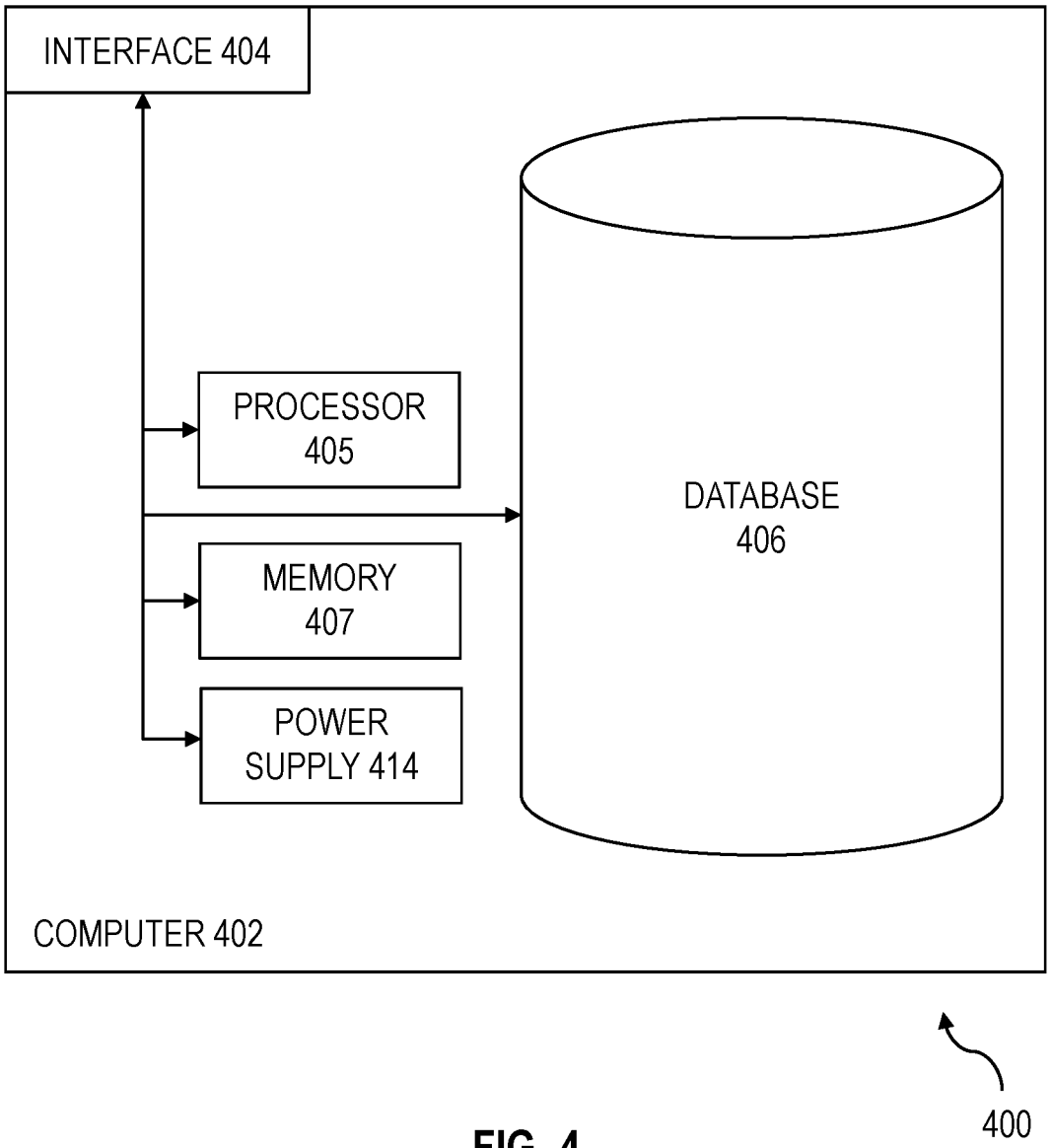
FIG. 4 is a block diagram of an example computer system which can be included with the bottomhole assembly of FIG. 2.

FIG. 4 is a block diagram of an example computer system 400 used to provide computational functionalities associated with described algorithms, methods, functions, processes, flows, and procedures, as described in this specification, according to an implementation. The illustrated computer 402 is intended to encompass any computing device such as a server, desktop computer, laptop/notebook computer, one or more processors within these devices, or any other processing device, including physical or virtual instances (or both) of the computing device. Additionally, the computer 402 can include a computer that includes an input device, such as a keypad, keyboard, touch screen, or other device that can accept user information, and an output device that conveys information associated with the operation of the computer 402, including digital data, visual, audio information, or a combination of information.

The computer 402 includes an interface 404. Although illustrated as a single interface 404 in FIG. 4, two or more interfaces 404 may be used according to particular needs, desires, or particular implementations of the computer 402. Although not shown in FIG. 4, the computer 402 can be communicably coupled with a network. The interface 404 is used by the computer 402 for communicating with other systems that are connected to the network in a distributed environment. Generally, the interface 404 comprises logic encoded in software or hardware (or a combination of software and hardware) and is operable to communicate with the network. More specifically, the interface 404 may comprise software supporting one or more communication protocols associated with communications such that the network or interface's hardware is operable to communicate physical signals within and outside of the illustrated computer 402.

The computer 402 includes a processor 405. Although illustrated as a single processor 405 in FIG. 4, two or more processors may be used according to particular needs, desires, or particular implementations of the computer 402. Generally, the processor 405 executes instructions and manipulates data to perform the operations of the computer 402 and any algorithms, methods, functions, processes, flows, and procedures as described in this specification.

The computer 402 can also include a database 406 that can hold data for the computer 402 or other components (or a combination of both) that can be connected to the network. Although illustrated as a single database 406 in FIG. 4, two or more databases (of the same or combination of types) can be used according to particular needs, desires, or particular implementations of the computer 402 and the described functionality. While database 406 is illustrated as an integral component of the computer 402, database 406 can be external to the computer 402.

The computer 402 also includes a memory 407 that can hold data for the computer 402 or other components (or a combination of both) that can be connected to the network. Although illustrated as a single memory 407 in FIG. 4, two or more memories 407 (of the same or combination of types) can be used according to particular needs, desires, or particular implementations of the computer 402 and the described functionality. While memory 407 is illustrated as an integral component of the computer 402, memory 407 can be external to the computer 402. The memory 407 can be a transitory or non-transitory storage medium.

The memory 407 stores computer-readable instructions executable by the processor 405 that, when executed, cause the processor 405 to perform operations, such as transmitting a sidewall coring signal to the sidewall coring bits 203 to obtain sidewall core samples 250 or any of the steps of method 350. The computer 402 can also include a power supply 414. The power supply 414 can include a rechargeable or non-rechargeable battery that can be configured to be either user- or non-user-replaceable. The power supply 414 can be hard-wired. There may be any number of computers 402 associated with, or external to, a computer system containing computer 402, each computer 402 communicating over the network. Further, the term "client," "user," "operator," and other appropriate terminology may be used interchangeably, as appropriate, without departing from this specification. Moreover, this specification contemplates that many users may use one computer 402, or that one user may use multiple computers 402.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

drilling a subterranean formation using a drill bit of a bottomhole assembly to form a wellbore in the subterranean formation, the bottomhole assembly comprising a storage chamber, a plurality of sidewall coring bits, and a hydraulic motor coupled to each sidewall coring bit;

while the bottomhole assembly is disposed within the wellbore, cutting into a sidewall of the wellbore using the plurality of sidewall coring bits to obtain a plurality of sidewall core samples, wherein cutting into the sidewall using the plurality of sidewall coring bits comprises using the hydraulic motor to rotate each sidewall coring bit;

while cutting into the sidewall of the wellbore using the plurality of sidewall coring bits, circulating fluid through the wellbore; and receiving the plurality of sidewall core samples within the storage chamber.

2. The method of claim 1, wherein the plurality of sidewall coring bits are distributed around a circumference of the bottomhole assembly.

3. The method of claim 2, wherein each sidewall coring bit is disposed at the same depth along a longitudinal length of the bottomhole assembly.

4. The method of claim 2, wherein the bottomhole assembly is retained in the wellbore between drilling the subterranean formation and cutting into the sidewall of the wellbore.

5. The method of claim 4, comprising, after storing the plurality of sidewall core samples within the storage chamber:

pulling the bottomhole assembly out of the wellbore;

retrieving the plurality of sidewall core samples from the storage chamber; and analyzing the plurality of sidewall core samples.

6. The method of claim 4, comprising drilling further into the subterranean formation using the drill bit of the bottomhole assembly after receiving the plurality of sidewall core samples within the storage chamber.

7. The method of claim 6, wherein the bottomhole assembly is retained in the wellbore between receiving the plurality of sidewall core samples and drilling further into the subterranean formation.

8. The method of claim 7, wherein cutting into the sidewall of the wellbore proceeds at a first depth within the wellbore, the plurality of sidewall core samples is a first plurality of sidewall core samples, and the method comprises:

after drilling further into the subterranean formation, cutting into the sidewall of the wellbore at a second depth within the wellbore using the plurality of sidewall coring bits to obtain a second plurality of sidewall core samples; and receiving the second plurality of sidewall core samples within the storage chamber.

9. The method of claim 8, wherein:

the storage chamber comprises a plurality of subsections;

receiving the first plurality of sidewall core samples within the storage chamber comprises receiving the first plurality of sidewall core samples within a first subsection of the storage chamber; and receiving the second plurality of sidewall core samples within the storage chamber comprises receiving the second plurality of sidewall core samples within a second subsection of the storage chamber.

10. The method of claim 9, comprising:

correlating the first subsection of the storage chamber to the first depth; and correlating the second subsection of the storage chamber to the second depth.

11. A bottomhole assembly comprising:

a drill bit at an end of the bottomhole assembly, the drill bit configured to rotate to cut into a subterranean formation and form a wellbore in the subterranean formation;

a plurality of sidewall coring bits, the plurality of sidewall coring bits distributed around a circumference of the bottomhole assembly, each sidewall coring bit configured to, in response to being rotated, cut into a sidewall of the wellbore formed by the drill bit and obtain a sidewall core sample;

a hydraulic motor coupled to each sidewall coring bit, the hydraulic motor configured to rotate each sidewall coring bit independent of the rotation of the drill bit; and a storage chamber disposed between the drill bit and the plurality of sidewall coring bits, the storage chamber configured to receive and store the sidewall core sample obtained by any one of the sidewall coring bits.

12. The bottomhole assembly of claim 11, wherein each sidewall coring bit is disposed at the same depth along a longitudinal length of the bottomhole assembly.

13. A computer-implemented method comprising:

while a bottomhole assembly comprising a plurality of sidewall coring bits is disposed at a first depth within a wellbore in a subterranean formation, transmitting a first sidewall coring signal to cause the plurality of sidewall coring bits to obtain a first plurality of sidewall core samples;

in response to obtaining the first plurality of sidewall core samples, tagging each of the first plurality of sidewall core samples with a first identifier and at least one of the first depth or a timestamp at which the first plurality of sidewall core samples was obtained;

while the bottomhole assembly is disposed at a second depth within the wellbore, transmitting a second sidewall coring signal to cause the plurality of sidewall coring bits to obtain a second plurality of sidewall core samples;

in response to obtaining the second plurality of sidewall core samples, tagging each of the second plurality of sidewall core samples with a second identifier and at least one of the second depth or a timestamp at which the second plurality of sidewall core samples was obtained; and generating a map of the subterranean formation at least based on the first depth, the second depth, the first plurality of sidewall core samples, and the second plurality of sidewall core samples.

14. The computer-implemented method of claim 13, wherein the bottomhole assembly comprises a storage chamber, wherein the method comprises:

determining that the first plurality of sidewall core samples is stored within a first portion of the storage chamber; and determining that the second plurality of sidewall core samples is stored within a second portion of the storage chamber.

* * * * *